United States Patent [19]

Connell et al.

[11] 3,992,910

[45] Nov. 23, 1976

[54] ROLLING OPERATIONS

[75] Inventors: Gordon Sidney Connell; Ronald Carl Andriessen, both of Cheltenham, England

[73] Assignee: Formflo Limited, Cheltenham, England

[22] Filed: July 21, 1975

[21] Appl. No.: 597,737

[30] Foreign Application Priority Data

July 24, 1974 United Kingdom ..... 32784/74

[52] U.S. Cl. ..... 72/7; 72/106; 72/110

[51] Int. Cl.[2] ..... B21H 1/12

[58] Field of Search ..... 72/7, 22, 23, 102, 105, 72/106, 107, 108, 110; 29/148.4 R

[56] References Cited

UNITED STATES PATENTS

| | | | |
|---|---|---|---|
| 3,803,890 | 4/1974 | Connell | 72/107 |
| 3,857,147 | 12/1974 | Gerat | 29/148.4 |

*Primary Examiner*—Lowell A. Larson

*Attorney, Agent, or Firm*—Pollock, Vande Sande & Priddy

[57] ABSTRACT

A method of rolling an initially annular workpiece between forming rolls in which after the forming rolls have been fully advanced they are retracted initially slowly for a predetermined distance. The forming rolls can then be further retracted at a greater speed. The slow retraction reduces the out of roundness of the finished rolled ring.

3 Claims, 2 Drawing Figures

ROLLING OPERATIONS

This invention relates to improvements in rolling operations, particularly but not exclusively those described in British Pat. Specification No. 1,329,251 (corresponding to U.S. Pat. No. 3,803,890) and British Application No. 46833/71 (corresponding to U.S. Pat. No. 3,839,892).

After the growth control rolls and the forming rolls have fully advanced and rolling completed, the rolls are retracted.

It has now been found that improved rolled ring circularity can be achieved by initially retracting the main forming and growth control rolls slowly. Therefore, according to the invention there is provided a method of rolling an initially annular workpiece in a rolling machine comprising at least two forming rolls and growth control rolls, in which the workpiece is rolled between the forming rolls, at least one of which advances relatively towards another, to the required depth of roll; the at least one forming roll is then retracted, the speed of retraction being initially slowly for a predetermined distance dependent on the gap between the forming rolls maximum diameter when in the dwell condition and the final diameter of the minimum form diameter of the rolled ring.

The minimum distance for which the rolls are retracted slowly also depends on the difference between the mandrel diameter and the maximum finished rolled bone diameter. The speed of retraction is governed by the type and section of the workpiece. After the required distance has been reached the rolls may then be retracted faster.

The controlled slow retraction can reduce the out of round of a workpiece from approximately 0.015 inch to 0.0007 inch.

The invention will be further described by way of example and with reference to the accompanying drawings.

DESCRIPTION OF PREFERRED EMBODIMENTS

Figure 1:
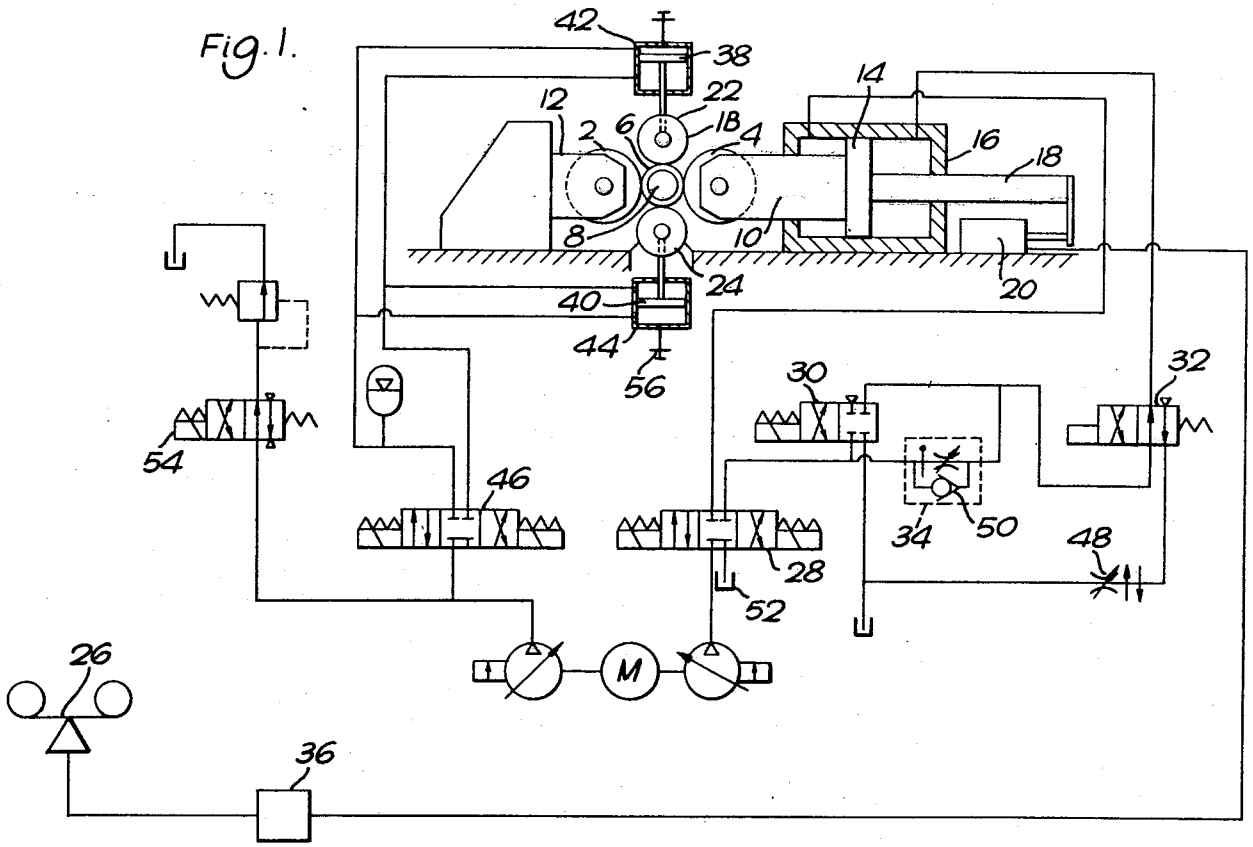
FIG. 1 shows a side view of a rolling machine for rolling a profile into the outer surface of annular workpiece, together with a hydraulic circuit for operating the machine.

Regarding FIG. 1, the rolling machine has two opposed forming rolls 2 and 4, between which is supported an annular workpiece 6 on a mandrel 8. The mandrel can be, for example, a split mandrel as described in our copending application Ser. No. 597,740, corresponding to British application No. 32,786/74. In the embodiment shown in FIG. 1 only the right hand roll 4 can be moved horizontally towards and away from the workpiece 6 but a rolling machine having both forming rolls movable can be used. This would involve only a simple change in the hydraulic circuitry. Both forming rolls 2 and 4 are each supported in a respective yoke 10 and 12. Yoke 10 is fixed but yoke 12 is connected to a piston 14 which is movable inside a cylinder 16. The piston is in turn connected by means of a piston rod 18 to a digital or analoque transducer 20.

At right angles to the forming rolls 2 and 4 are two opposed growth control rolls 22 and 24 for reducing any ovality in the workpiece 6 produced by the forming rolls 2 and 4 during rolling. The growth control rolls are rotatably supported by any suitable means such as that described in British Specification No. 1,329,251 corresponding to U.S. Pat. No. 3,803,890.

Prior to the rolling operation the annular workpiece 6 to be rolled is weighed in a weighing unit 26. The difference in weight between the workpiece 6 under consideration and a nominally sized workpiece produces a digital or analogue output signal during rolling. After weighing the workpiece 6 is inserted in the rolling machine ready for the start of the rolling operation.

To advance the forming roll 4, hydraulic fluid is pumped to a change over valve 28, which is set in the position which allows fluid to be conveyed to the back of the piston 14 to advance the roll 4. From the changeover valve 28 the hydraulic fluid passes via two other changeover valves 30 and 32 to the back of piston 14 which is thereby made to advance under the pressure of the fluid. The initial advancement of the forming roll 4 is relatively fast, but when the forming roll 4 is nearly in contact with the workpiece 6 its speed of advancement is slowed down by switching the changeover valve 30 so that the hydraulic fluid passes through a flow control valve 34.

As the forming roll 4 advances its movement is converted, by the transducer 20 to a signal, such as a voltage, which is compatible with that produced by the weighing unit 26, and these two signals are compared in a factoring unit 36. When the signals from the transducer 20 and the weighing unit 26 correspond the factoring unit 36 switches the changeover valve 28 to prevent hydraulic fluid continuing to flow to the back of piston 12.

When the forming roll 4 is fully advanced it remains in the advanced position for a period of time known as the dwell time. The extent of advancement of the forming roll 4 or the dwell time depends on the difference between the weight of the workpiece being rolled and the weight of a nominally sized workpiece.

As mentioned above the rolling machine also includes a pair of growth control rolls 22 and 24. Each growth control roll 22 and 24 is connected to a respective piston 38 and 40 which is movable inside a cylinder 42 and 44. During rolling hydraulic fluid is supplied to the back of pistons 38 and 40 via a changeover valve 46. This allows the pistons 38 and 40 to advance as the form is produced in the workpiece, keeping the growth control rolls 22 and 24 in contact with the workpiece 6 with sufficient force to prevent the workpiece from distorting to any large extent.

When the forming roll 4 reaches a predetermined depth of roll the force exerted by the growth control rolls are locked into position. There extent of advancement is regulated by fixed adjustable stops which are described in more detail in our British application No. 32785/74 corresponding to co-pending application Ser. No. 597,738, filed concurrently herewith.

After the completion of the dwell time change over 28 is switched so that hydraulic fluid can pass to the front of piston 14 thereby causing the forming roll 4 to retract. The retraction of the forming roll 4 in turn causes hydraulic fluid to flow to changeover valve 32 which is now set so that fluid passes through a slow-back off control valve 48. This control valve 48 limits the speed with which the forming roll can retract. The roll is initially retracted slowly to prevent any distortion in the shape of the rolled workpiece which could occur if the forming rolls 4 was retracted too fast. After the forming roll 4 has been retracted a predetermined distance its speed of retraction can safely be increased. This is effected by switching the changeover valve 32 so that hydraulic fluid flows through check valve 50 then back to a hydraulic fluid resevoir 52 via changeover valve 28.

Figure 2:
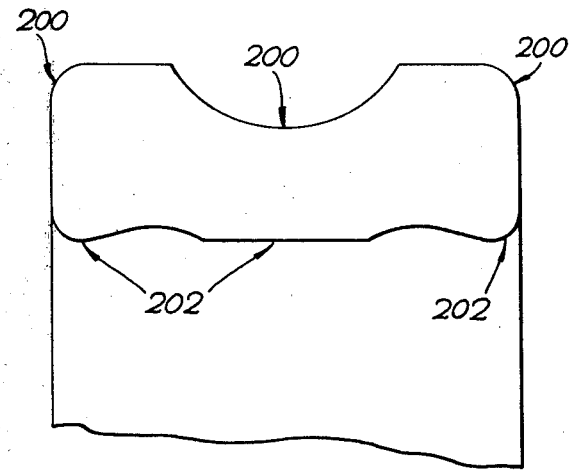
FIG. 2 shows the effect of 'bore ripple' in a rolled ring.

FIG. 2 shows a section of a bearing ring. The maximum forming force is generated at the formed region, indicated by numeral 200. As a result a corresponding deformation is produced at the region 202. This deformation may only be a few thousandths of an inch but its effect is far from negligible. By using the method according to the invention this "bore ripple" phenomenon can be reduced and sometimes even eliminated.

What we claim is:

1. A method of forming an inner bearing ring, having a required final diameter, from an annular workpiece in a rolling machine having a mandrel for supporting said workpiece, two oppositely disposed forming rolls, one at each side of the mandrel, two oppositely disposed growth control rolls, one at each side of the mandrel and at right angles to said forming rolls, said forming rolls being capable of being advanced relative to one another to a required depth of roll and then retracted relative to one another, the method comprising the steps of:

a. advancing said forming rolls relative to one another until said required depth of roll in said workpiece is reached, whereat a gap between said forming rolls exists, b. dwelling said forming rolls at said required depth of roll, said c. retracting said forming rolls relative to one another, initially slowly for a predetermined distance to reduce out of round occurring in said rolled inner bearing ring, and then retracting said forming rolls relative to one another quickly to produce an inner bearing ring having said required final diameter, said predetermined distance over which said forming rolls are retracted slowly depending on the difference between said required final diameter and said gap between said forming rolls after step (a).

2. A method according to claim 1 in which the speed of retraction depends upon the type and section of the workpiece.

3. A method according to claim 1 in which the out of round of a rolled ring is reduced to approximately 0.0007 inches by the initial slow return.

* * * * *